United States Patent [19]

Pourailly et al.

[11] Patent Number: 5,034,752

[45] Date of Patent: Jul. 23, 1991

[54] MULTIPLE-BEAM ANTENNA SYSTEM WITH ACTIVE MODULES AND DIGITAL BEAM-FORMING

[75] Inventors: Jean-Louis Pourailly, Vincennes; Joseph Roger, Bures Sur Yvette, both of France

[73] Assignee: Thomson CSF, Puteaux, France

[21] Appl. No.: 544,321

[22] Filed: Jun. 27, 1990

[30] Foreign Application Priority Data

Jul. 4, 1989 [FR] France ..... 89 08960

[51] Int. Cl.[5] ..... H01Q 3/22; H01Q 3/24; H01Q 3/26

[52] U.S. Cl. ..... 342/373

[58] Field of Search ..... 342/373, 149, 154

[56] References Cited

U.S. PATENT DOCUMENTS

| | | | |
|---|---|---|---|
| 4,216,475 | 8/1980 | Johnson . | |
| 4,277,787 | 7/1981 | King . | |
| 4,338,605 | 7/1982 | Mims . | |
| 4,907,004 | 3/1990 | Zacharatos et al. | 342/373 |
| 4,922,257 | 5/1990 | Saito et al. | 342/377 |

FOREIGN PATENT DOCUMENTS 0257964 3/1988 European Pat. Off. .

OTHER PUBLICATIONS

Wissenschaftliche Berichte AE6–Telefunken, vol. 54, Nos. 1, 2, 1981 pp. 25–43.

Microwave Jounral, vol. 30, No. 1, Jan. 1987 (pp. 107–8).

*Primary Examiner*—Theodore M. Blum

*Attorney, Agent, or Firm*—Roland Plottel

[57] ABSTRACT

Such a system typically comprises: a plurality of elementary antennas configured in an array, each having an associated active module, a plurality of DBF modules, each receiving a microwave signal coming from the active modules and delivering complex digital data (I, Q) representing the input signal; and DBF processor means preparing weighted sums on the basis of this complex digital data, the weighting corresponding to a reception channel defining a narrow beam of the radiation pattern of the antenna. The system further comprises a plurality of prefiltering spatial circuits, each of which receives a plurality of signals coming from the active module and delivers, to an associated DBF module, a signal which is a sum, weighted in amplitude, of certain of the signals received at input, each DBF module being thus associated with a sub-array, the different sub-arrays thus forming being imbricated with one another and the weighting being chosen so that the pattern of the sub-array is a sectoral pattern that essentially lets through only the signals coming from a restricted zone of space. The number of spatial prefiltering circuits and DBF modules is smaller than that of the elementary antennas, and the processor means simultaneously process the outputs signals from the spatial prefiltering circuits so as to obtain, for the radiation pattern of the antenna, an equivalent number of simultaneous, distinct beams of homogeneous quality.

4 Claims, 5 Drawing Sheets

MULTIPLE-BEAM ANTENNA SYSTEM WITH ACTIVE MODULES AND DIGITAL BEAM-FORMING

BACKGROUND OF THE INVENTION

The present invention concerns an antenna system with active modules and digital beam-forming.

In digital beam forming (DBF) signals delivered by elementary antennas, configured in an array, are used to prepare a sum signal of all these signals after they have been weighted by appropriate coefficients. When there is a phase relationship among the incident waves picked up by the elementary antennas, it can be shown that, under certain conditions, the sum signal is then the signal that would be obtained by the antenna array formed by elementary antennas, but with a relationship of illumination defined by the weighting coefficients.

DBF consists in the digital execution of this weighted summation of the signals delivered by the elementary antennas.

Moreover, an electron scanning is done by the application of a variable and controlled phase shift to the signals delivered by the elementary antennas (or, in transmission, applied to them) so that the grouping together of the different phase shifts, combined with the pitch of the array, produces a "major lobe", the direction of which, with respect to the central axis of the array, forms a variable angle, modified according to need.

Typically, a digital beam-forming antenna comprises:

a plurality of elementary antennas configured in an array;

a plurality of transmission and/or reception amplifier active modules, equal in number to the elementary antennas and each associated, respectively, with one of these modules (the term "active module" shall be taken to mean a set of active elements, such as power amplifiers for transmission, low-noise amplifiers for reception, phase-shifters etc., located in the vicinity of a radiating element of an array antenna. Generally, the energy within the active module remains at the microwave frequency of the radar).

a plurality of DBF modules, each receiving a microwave signal coming from active modules and delivering complex digital data at output, said data representing the signal received at input (the term "DBF module" shall designate such an organ, the input of which receives the microwave signal after low-noise amplification and the output of which is in the form of a complex number representing the input analog signal, namely a number with two parameters, corresponding to two channels in quadrature, called the "sine channel" and the "cosine channel"), and DBF processing means using the complex digital data delivered by the different DBF modules of the system to prepare weighted sums of said data, wherein the weighting corresponds to a reception channel defining a narrow beam of the radiation pattern of the antenna.

At present, there are two known methods for fitting out an active array antenna with DBF modules in this way.

In the first technique, a DBF module is placed at the output of each reception channel of the active modules.

Although this approach permits every possible configuration, it has the drawback of making it necessary to have a great number of DBF modules (array antennas made at present typically comprise 4000 to 5000 elementary antennas and, hence, as many active modules).

This means paying a high penalty in the form of two consequences:

firstly, very high cost (owing to the large number of modules to be provided for), and, secondly, a very great flow of data to be managed by the DBF processor since this processor will have to achieve real-time processing of as many complex signals as there are DBF modules, namely several thousands of complex signals.

In the second technique, the elementary antennas of the array are assembled in adjacent sub-arrays obtained by the combination of the signals coming from neighboring active modules, and only one DBF module is provided for each sub-array.

This approach, of course, very greatly diminishes the above-mentioned drawbacks since the number of DBF modules may be considerably reduced. However, it has the drawback of permitting only one good-quality beam since if there is any deviation from the direction of aim, the computed beams will have array lobes that are often unacceptable.

To aim the sub-arrays in the direction of analysis, it is necessary to provide for an electron scanning and a sequential (and no longer simultaneous as in the first example) processing of the items of information, thus making this technique costly in terms of the rate of refreshing the information when several directions have to be managed (i.e. when several beams are needed), owing to this sequential functioning mode.

SUMMARY OF THE INVENTION

One of the aims of the invention is to overcome these various drawbacks by proposing a DBF antenna architecture with active modules enabling the simultaneous managing of several beams while, however, placing a significant limit on the quantity of information to be processed by the processor and, in one of the embodiments, also making a significant reduction in the necessary number of DBF modules.

Thus, in a first embodiment, an attempt will be made chiefly to reduce the number of DBF modules by associating, with each DBF module, a sub-array the pattern of which is a sectoral pattern and, therefore, lets through only the signals coming from the zone of the space in which it is sought to establish the multiple-beam function.

This characteristic, which shall subsequently be called "spatial prefiltering" is made possible, according to a first embodiment of the invention, by the fact that, in a system of DBF antennas of the type defined above:

the system further has a plurality of spatial prefiltering circuits, each one of which receives, at input, a plurality of signals coming from the active modules placed upline and delivers, at output, to an associated DBF module placed downline, a signal which is a sum, weighted in amplitude, of certain of the signals received at input, each DBF module being thus associated with a sub-array of the array of elementary antennas, the different sub-arrays thus formed being imbricated with one another and the weighting of the signals of each sub-array being chosen so that its pattern is sectoral pattern essentially letting through only the signals coming from a restricted zone of space, the number of these spatial prefiltering circuits as well as the DBF modules associated with them is smaller than the number of elementary antennas, and the DBF processor means simultaneously process the output signals from the spatial prefiltering circuits so as to obtain, for the radiation pattern of the antenna, an equivalent number of distinct, simultaneous and narrow beams of homogeneous quality.

In a second embodiment of the invention, the "spatial prefiltering" serves essentially to reduce the quantity of information to be processed by the DBF processor, without its being sought to reduce the number of DBF modules.

In this case, there is provision for as many DBF modules as there are active modules, these DBF modules are positioned immediately after each corresponding active module (besides, the two modules may be integrated), and the sub-arrays are then formed by computing the weighted sums directly from the signals thus digitalized.

More precisely, according to this second embodiment of the invention:

the system further includes spatial prefiltering means receiving, at input, the signals delivered by the DBF modules and delivering, at output, sums, weighted in amplitude, of certain of the signals received at input, to the DBF processor means positioned downline, so as to form a sub-array of the array of elementary antennas, the different sub-arrays thus formed being imbricated with one another and the weighting of the signals of each sub-array being chosen so that its pattern is a sectoral pattern essentially letting through only the signals coming from a restricted zone of space, and the DBF processor means simultaneously process the output signals from the spatial prefiltering circuits so as to obtain, for the radiation pattern of the antenna, an equivalent number of distinct, simultaneous and narrow beams of homogeneous quality.

In this second embodiment, the spatial prefiltering means may notably by implemented by a programmable automaton.

Advantageously, in either embodiment, the weighting done by the DBF processor means is an adaptive weighting that provides for the convergence of the aiming in the desired spatial direction.

BRIEF DESCRIPTION OF THE DRAWINGS

Exemplary embodiments of the invention shall now be described with reference to the appended drawings.

DESCRIPTION OF PREFERRED EMBODIMENTS

Figure 1:
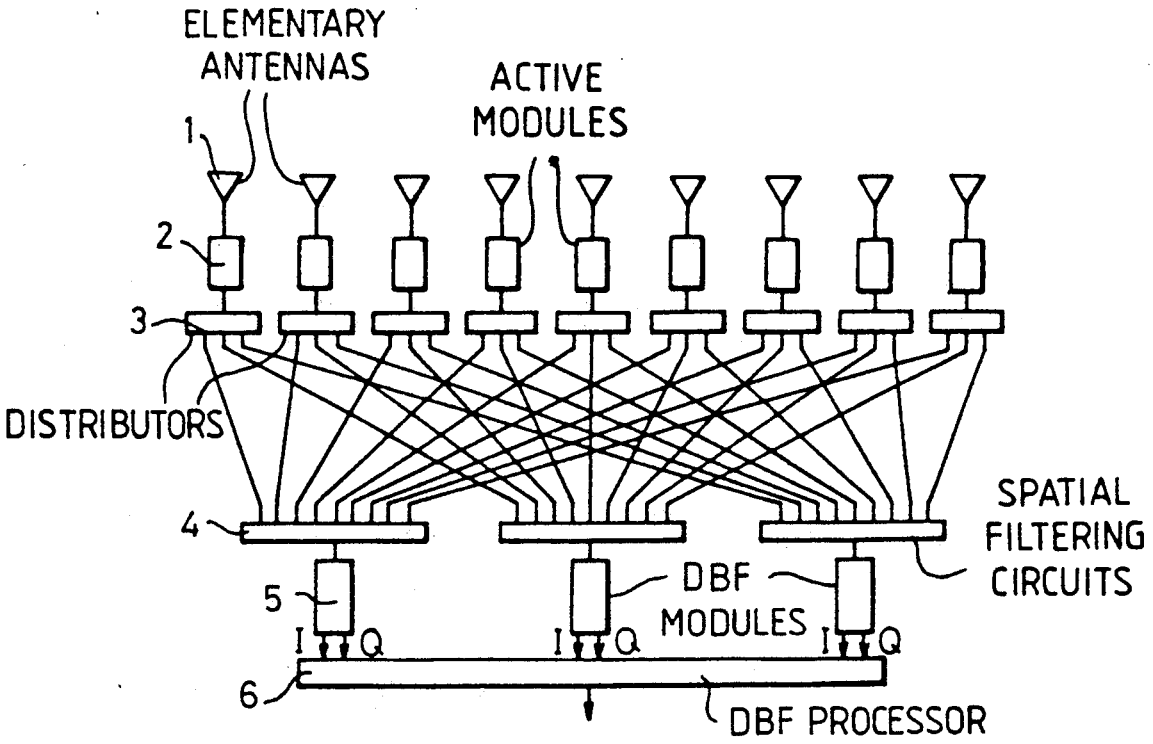
FIG. 1 is a schematic illustration of the above-mentioned first embodiment of the invention.

FIG. 1 gives a schematic illustration of the first embodiment of the invention. The reference 1 designates the elementary antennas of the array (for the clarity of the drawing, only a limited number of these elementary antennas is shown. Actually, their number is far greater; it is typically of the order of 4000 to 5000).

With each elementary antenna, there is associated an active module 2, of a type known per se (the structure of which shall be described further below with reference to FIG. 3) essentially formed by the reception and/or transmission amplifier circuits.

In a manner that is characteristic of the invention, a plurality of imbricated sub-arrays (three in FIG. 1) is formed by means of equi-amplitude and equi-phase distributors 3, which distribute the signals coming from the amplifiers to a certain number (three in the example shown) of spatial prefiltering arrays 4, the role of which is to perform the summing of the signals that they receive at input in applying, to these signals, amplitude weighting coefficients that are characteristic of each of the sub-arrays that are to be set up.

To this effect, through the imbrication, the surface of the sub-arrays ma be chosen so as to obtain patterns with a very clean secondary radiation, namely a pattern that is very close to an ideal sectoral pattern, for it is possible, in effect, to assign a number of signals, to each sub-array, sufficient to establish the requisite weighting.

The output signal of each of these spatial prefiltering circuits 4 (namely the signal corresponding t each of the sub-arrays that have been set up) is applied at input to a known type of DBF module 5 (the structure of which shall be described further below with reference to FIG. 4) which delivers a complex digital value at output, in the form of two signals I and Q (the "sine channel" and the "cosine channel" mentioned further above).

The I and Q components of the complex values delivered by the different DBF modules of the system are applied to a DBF processor 6 which will simultaneously process the digital values corresponding to each of the sub-arrays, thus making it possible, as sought, to obtain a plurality of simultaneous pencils or narrow beams of homogeneous quality.

The DBF computer may, advantageously, be an "intelligent" looped device that uses appropriate algorithms to deliver an adaptive signal that enables the aiming to be done in the precise direction of space where it is needed, in avoiding jammers through the creation of "holes" in the pattern in the direction of these jammers. Thus we obtain the desired result of an antenna, the pattern of which is formed by a "cluster" of narrow beams that can be tuned with precision, are protected against jamming and have homogeneous quality.

Figure 5:
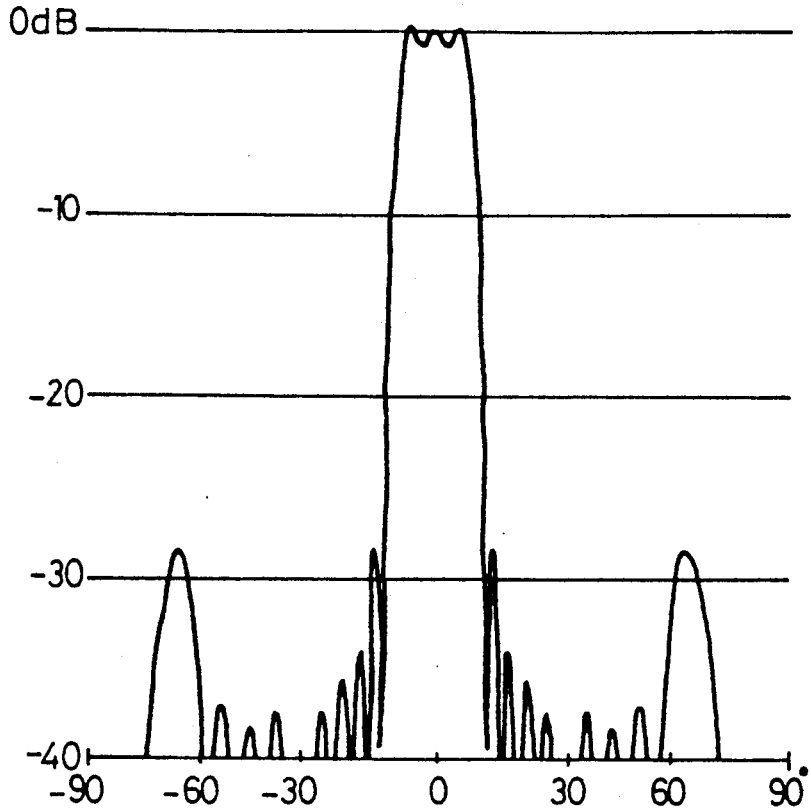
FIG. 5 is an example of a pattern of each of the imbricated sub-arrays, measured for the embodiment of FIG. 1.

FIG. 5 shows an example of a pattern measured for one of the imbricated sub-arrays (namely, a pattern obtained by an appropriate weighting in one of the spatial prefiltering circuits 4) with, as can be seen, a central major lobe that makes an approximate definition of the ideal sectoral pattern mentioned further above.

Figure 6:
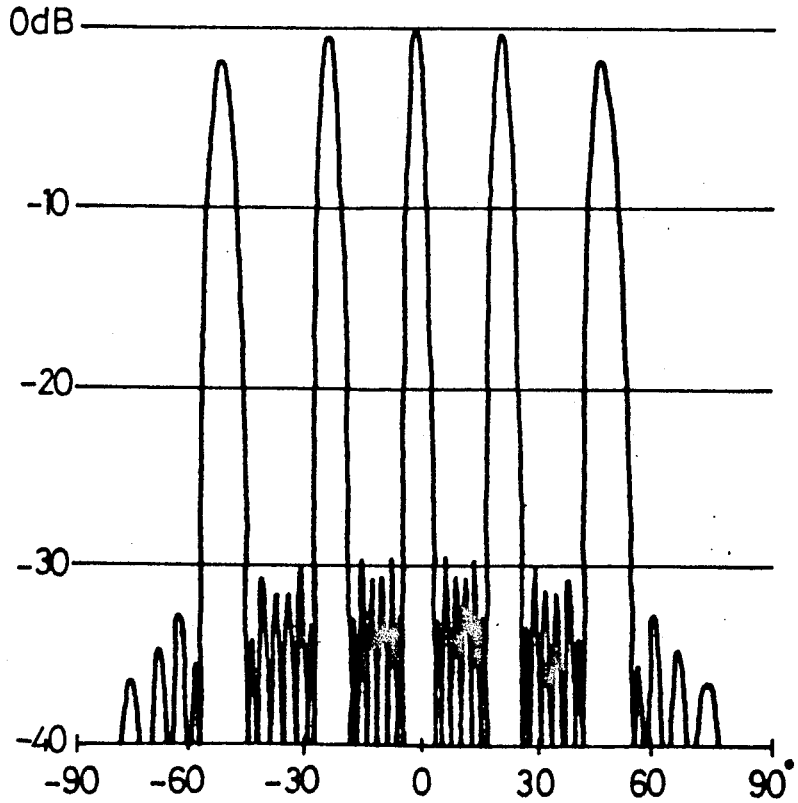
FIG. 6 corresponds, in this same case, to the array patterns obtained by the DBF receivers alone.
Figure 7:
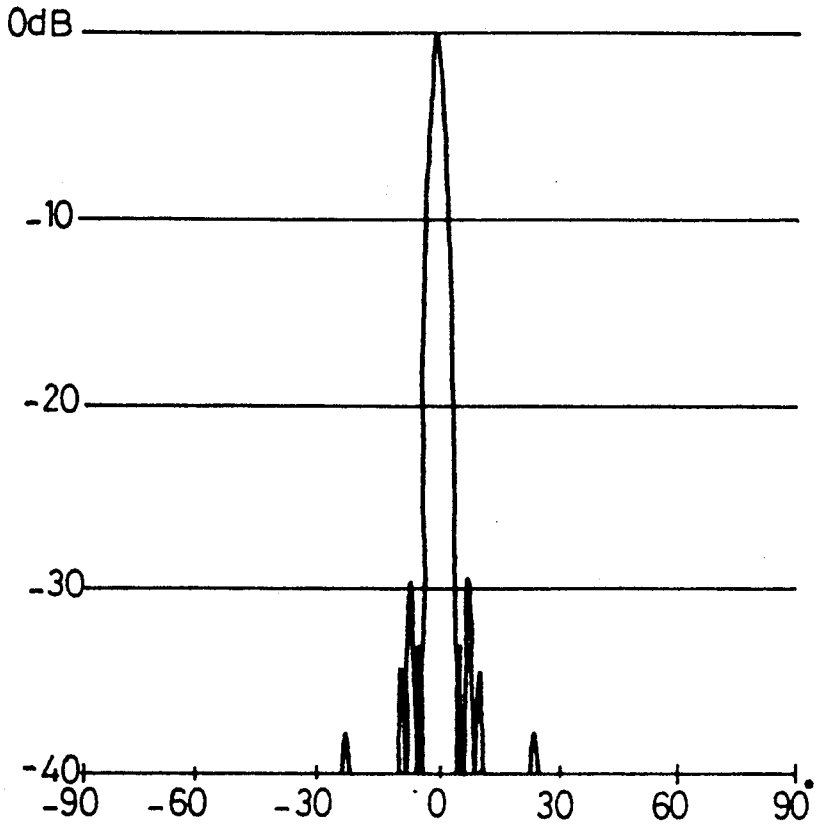
FIG. 7 corresponds to the combination of the patterns of FIGS. 5 and 6, namely the final pattern of the DBF beam after prefiltering.

FIG. 6 shows the array pattern obtained by the DBF modules alone, i.e. without the prefiltering of the sub-arrays, and FIG. 7 shows this same pattern after prefiltering, i.e. the pattern obtained by combining the separate patterns of FIGS. 5 and 6. It is thus seen that the important lobes of the pattern of FIG. 6 disappear practically completely after going through the prefilter of the sub-arrays.

Figure 8:
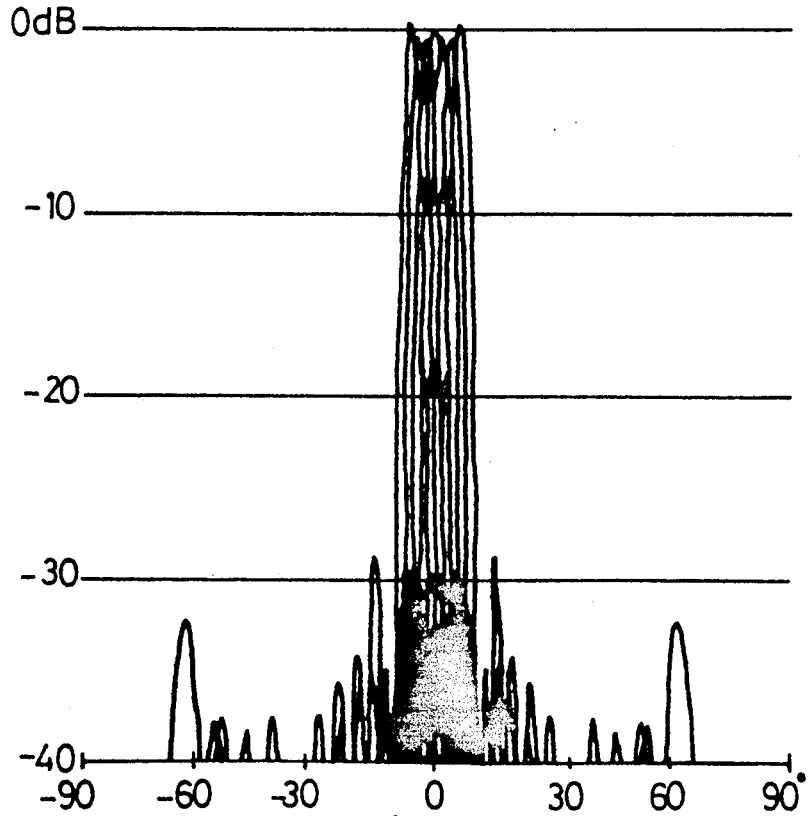
FIG. 8 illustrates the possibilities of electron scanning by the DBF modules within the pattern of FIG. 5.

FIG. 8 illustrates the possibility available, with one and the same set of data, of forming DFM lobes throughout the zone defined by the prefilter. To this effect, an electron scanning resulting from an appropriate command of the DFM modules is used to translate the pattern of FIG. 6, and hence its central lobe, by a few degrees or fractions of a degree, rightwards or leftwards, so as to make this central lobe scan the entire angular sector defined by the sub-array.

FIG. 8 thus corresponds to a series of patterns homologous to the pattern of FIG. 7, obtained with one and the same spatial prefiltering pattern (that of FIG. 5) but in shifting the pattern of FIG. 6 some degrees leftwards or rightwards by an appropriate command of the DBF modules.

Finally, using the electron phase-shifters of the active modules (and not those of the DBF modules, which are used only for the precise aiming), it is possible to orient the angular sector of the prefilter differently, as a function of need.

Figure 9:
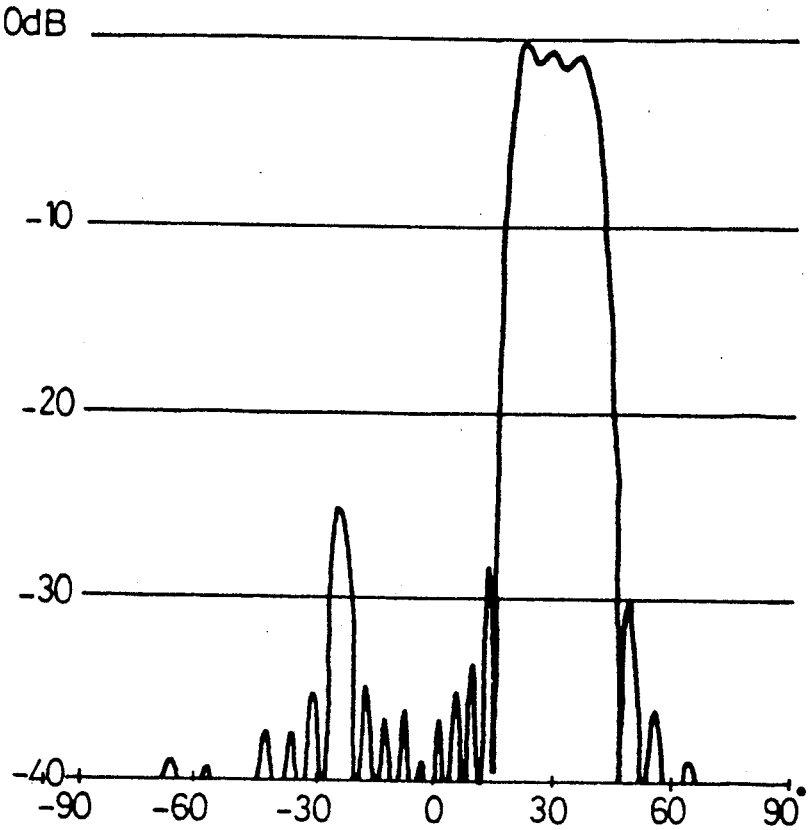
FIGS. 9 and 10 are, respectively, homologous to FIGS. 5 and 7, but with the application of a deviation of about 30° through an appropriate control of the active modules.
Figure 10:
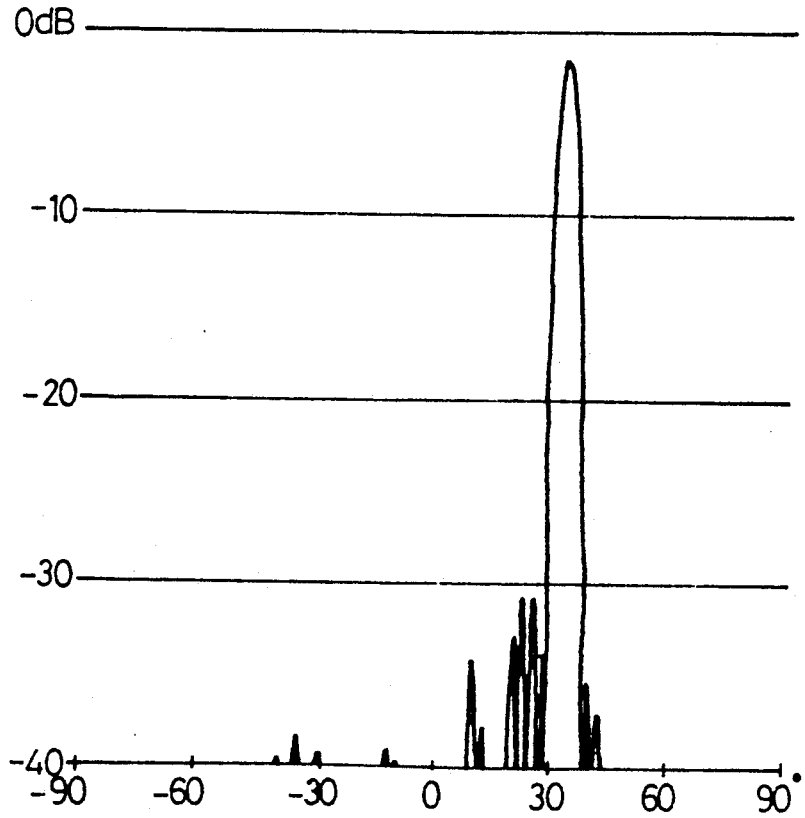

Thus, in FIGS. 9 and 10, instead of an aiming in the axis, a deviation of +30° is done, the pattern of FIG. 5 becomes that of FIG. 9 and the pattern of FIG. 7 becomes that of FIG. 10.

It is thus seen that a relatively extended zone of space can be scanned without difficulty while, at the same time, the properties of narrowness (and hence the anti-jamming quality) of the beam, permitted by the DBF technique, are preserved.

It will be seen that although, in FIG. 1, each of the spatial prefiltering circuits (i.e. sub-arrays) uses the signals delivered by the entire system, this characteristic is not indispensable and, in practice (notably to restrict the noise factor of the antenna when this antenna comprises a large number of active modules), it might become necessary to restrict the number of signals assigned to each sub-array. However, since the prefiltering takes place downline (in the direction of the reception) of the active modules, it is possible to use the signals coming from the amplifiers of these active modules for several prefilters, hence to achieve a very substantial imbrication without paying any penalty as regards the signal-to-noise ratio.

However, if the signal can be digitalized directly at the active module, this constraint of increase in the noise factor no longer comes into play, so that the spatial prefiltering can be adjusted as efficiently as possible without its being necessary to limit the number of signals assigned to each sub-array.

Besides, to simplify the description, the example taken has been that of a linear array. However, the invention is not restricted to an array of such a type, and can be applied to arrays of any shape, notably of surface or bulk arrays.

In the same way, the DBF array does not have to be, as shown in the illustration, an array with a regular pitch. It may have any distribution provided that array lobes are not generated within the prefiltered zone.

Figure 2:
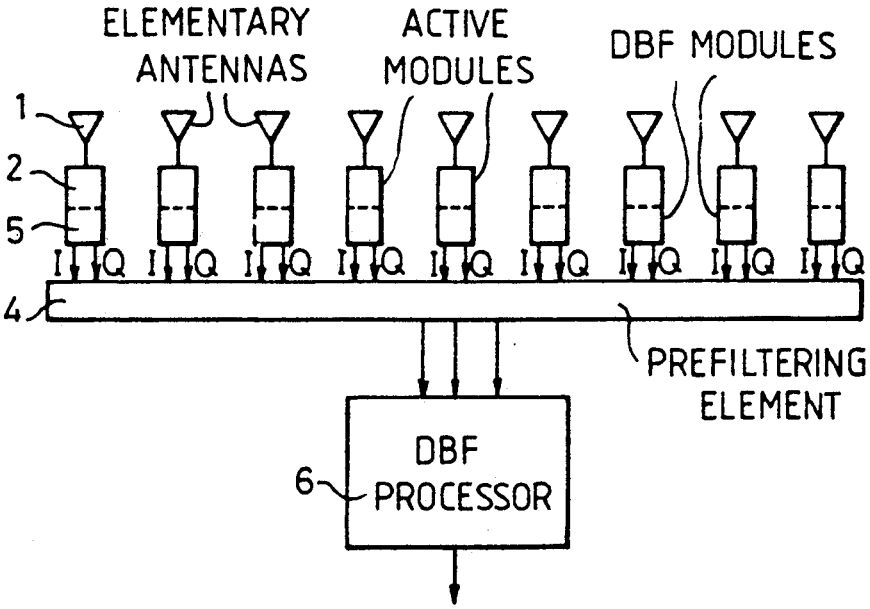
FIG. 2 is a schematic illustration of the above-mentioned second embodiment of the invention.

FIG. 2 illustrates a second embodiment of the invention, also using the same spatial prefiltering technique by replacing the meshing between the distributors 3 and the spatial prefiltering circuit 4 by a distribution done by computation directly on digital values.

To this effect, with each active module 2, there is associated a DBF module 5 (besides, the two modules may be physically integrated in a single circuit) delivering the complex numerical values I and Q to a digital prefiltering element 4 such as a distributed computer (preferably a programmable automaton) which will set up the sub-arrays directly by computation in determining the appropriate weighted sums on the basis of the upline digitalized signals.

These weighted sums are delivered to the DBF computer 6 which will process them in the same way as in the case of the first embodiment.

Of course, this approach does not make it possible to reduce the number of DBF modules as compared with the prior art approaches, but it nevertheless offers the advantage of considerably restricting the flow of information to be processed by the DBF computer 6, owing to the spatial prefiltering performed upline by the element 4.

Furthermore, as compared with the architecture of the embodiment of FIG. 1, this architecture provides the advantages of simplification of the connection systems, reduction in the number of encoding bits of the digital converters (for, owing to the spatial prefiltering, the dynamic range of the signals could be smaller) and distribution of the computing power in the vicinity of the modules where the pieces of data are produced—that is, the major part of the large-scale digital processing will take place in the vicinity of the active and DBF modules, thus lightening the task of the computer 6 to that extent.

Figure 3:
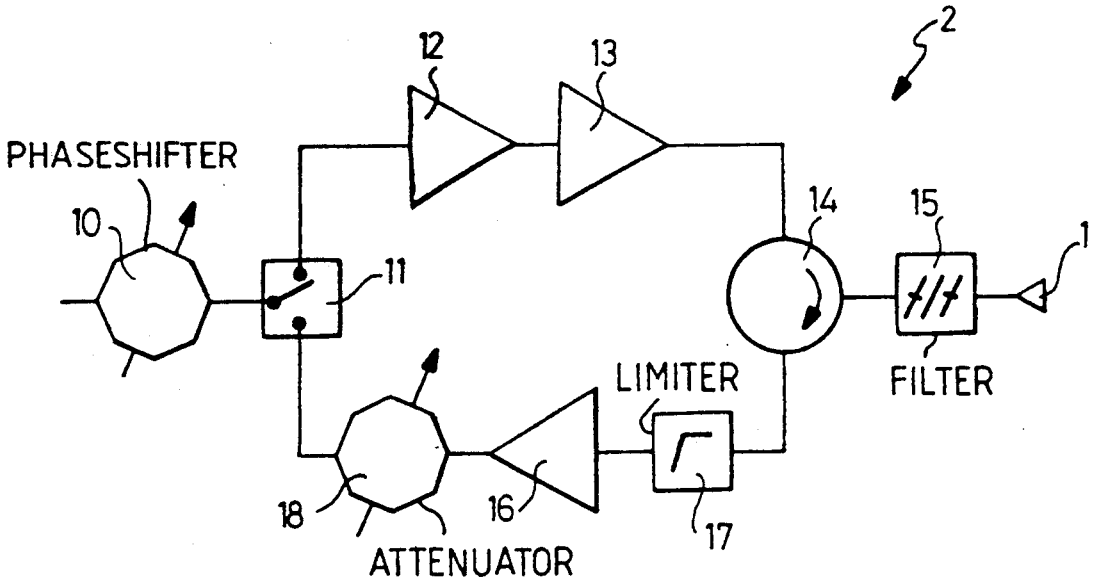
FIG. 3 is a block diagram showing the structure, known per se, of an active module.
Figure 4:
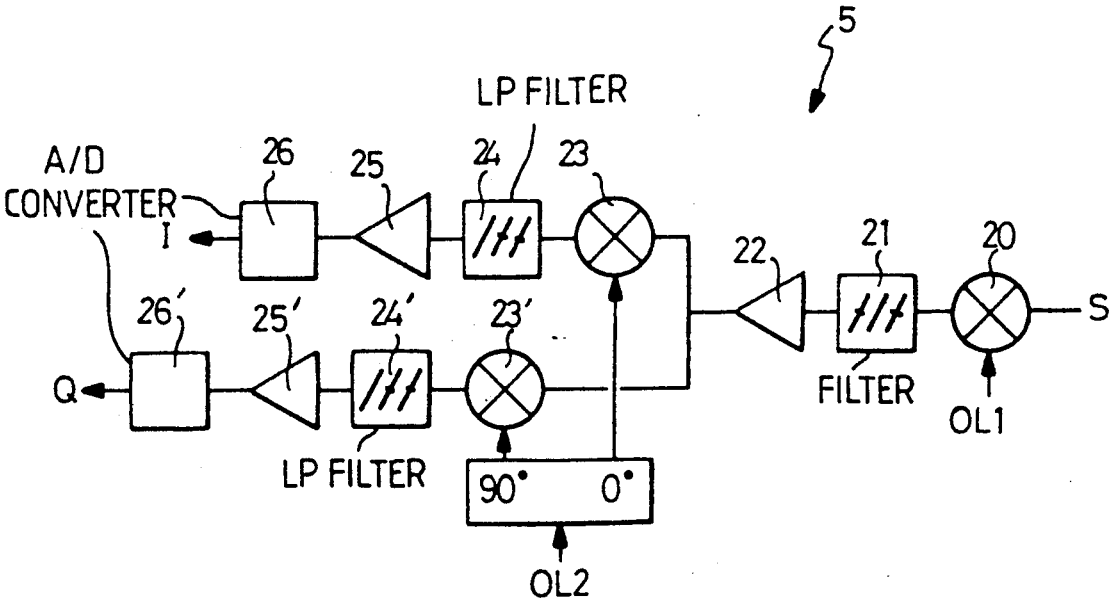
FIG. 4 is a block diagram showing the structure, known per se, of a DBF module.

FIGS. 3 and 4 illustrate, respectively, the general structure of the active modules 2 and of the DBF modules 5. These modules have been shown only schematically inasmuch as, essentially, they are structures known per se.

Each active module 2 is constituted (FIG. 3) by a phase-shifter 10 used to orient the wave plane at will. This phase-shifter is connected, firstly, to the transmission and reception circuits and, secondly, to a change-over switch 11. In transmission, this change-over switch connects the phase-shifter to a power amplifier formed by stages 12, 13 supplying the elementary antenna 1 through a circulator 14 and a harmonic filter 15. In reception, the elementary antenna 1, through the filter 15 and the circulator 14, supplies a low-noise amplifier 16, generally through a limiter stage 17. The amplifier 16 delivers the picked-up and amplified signal to the phase-shifter 10 (through the transmission/reception switch 11) by means of an attenuator 18 used for the adjusting of the level, notably for the weighting in amplitude of the elementary antenna in the array.

FIG. 4 illustrates the diagram of an analog type DBF module 5.

This module receives a microwave signal S at input. This microwave signal S is lowered to a first intermediate frequency, of the order of 1000 MHz, by a mixer 20 supplied by a local oscillator OL1, common to all the DBF modules. The signal at output of the mixer is filtered at 21 and amplified at 22, then subjected to a second change in frequency (to arrive at a second intermediate frequency of the order of 60 MHz), this second change in frequency being done on two similar channels each comprising a mixer 23, 23', a low-pass filter 24, 24' and a video amplifier 25, 25'. To obtain a complex signal that represents both the amplitude and the phase of the base signal, it is necessary to perform an amplitude/phase demodulation with two local oscillator OL2 signals in quadrature, these two signals being respectively applied to each of the two mixers 23 and 23'.

Finally, each of the two signals in quadrature is digitalized by a respective analog/digital converter 26, 26' to give the signals I (reference signal) and Q (signal in quadrature) delivered by each of the DBF modules.

It will be noted that this description corresponds to an analog DBF module, namely one in which the analog/digital conversion is done after demodulation. It is also possible to provide for a DBF digital module, i.e. one in which, since the digitalization is done upline, the amplitude/phase demodulation is done digitally, by computation and not by mixing and filtering of signals.

What is claimed is:

1. A digital beam-forming antenna with active modules comprising:

a plurality of elementary antennas configured in an array;

a plurality of amplifier active modules, equal in number to the elementary antennas and each associated, respectively, with one of these modules;

a plurality of spatial prefiltering circuits, each of which has a plurality of inputs each connected to one of said active modules and an output delivering a signal which is a sum, weighted in amplitude, of the signals received at input;

a plurality of DBF modules, each having an input connected to the output of a respective prefiltering circuit and two outputs giving, in digital form, complex data I, Q representing the signal received at input, each of said DBF modules being thus associated with a sub-array of the array of said elementary antennas, the different sub-arrays thus formed being interleaved with one another and the weighting of the signals of each sub-array being chosen so that its pattern is a sectoral pattern essentially letting through only the signals coming from a restricted zone of space, the number of said spatial prefiltering circuits as well as said DBF modules associated with them being smaller than the number of elementary antennas; and DBF processor means using the complex digital data delivered by said DBF modules to prepare weighted sums of this data according to predetermined weightings to obtain, for the radiation pattern of the antenna, a plurality of distinct, simultaneous and narrow beams.

2. The antenna system of claim 1, wherein the weighting achieved by the DBF processor means is an adaptive weighting providing for the convergence of aiming in a desired spatial direction.

3. A digital beam-forming antenna with active modules comprising:

a plurality of elementary antennas configured in an array;

a plurality of amplifier active modules, equal in number to the elementary antennas and each associated, respectively, with one of these modules;

a plurality of DBF modules, equal in number to the active modules and each associated, respectively, with one of these modules, each receiving the microwave signal coming from the active module and delivering, at output, complex digital data (I, Q) representing the signal received at input;

spatial prefiltering circuits having a plurality of inputs receiving said digital data from said DBF modules and a plurality of outputs to deliver weighted sums of at least certain of the digital data received at input, so as to form sub-arrays of the array of elementary antennas, the different sub-arrays thus formed being imbricated with one another and the weighting of the signals of each sub-array being chosen so that its pattern is a sectoral pattern essentially letting through only the signals coming from a restricted zone of space; and DBF processor means using the complex digital data delivered by said DBF modules of the system to prepare weighted sums of these data according to predetermined weightings to obtain, for the radiation pattern of the antenna, a plurality of distinct, simultaneous and narrow beams.

4. The antenna system of claim 3, wherein the weighting done by the DBF processor means is an adaptive weighting that provides for the convergence of aiming in a desired spatial direction.

* * * * *